US012480659B2

(12) United States Patent
Bauer et al.

(10) Patent No.: US 12,480,659 B2
(45) Date of Patent: Nov. 25, 2025

(54) VENT-FREE FIREPLACE HEAT REMOVAL SYSTEM AND ACCESSORIES ADAPTED FOR REMOVAL OF EXCESS HEAT FROM A ROOM WHEREIN THE VENT-FREE FIREPLACE IS LOCATED

(71) Applicant: EMPIRE COMFORT SYSTEMS, INC., Belleville, IL (US)

(72) Inventors: Nick Bauer, Belleville, IL (US); James McDonald, Mascoutah, IL (US)

(73) Assignee: Empire Comfort Systems, Inc., Belleville, IL (US)

( * ) Notice: Subject to any disclaimer, the term of this patent is extended or adjusted under 35 U.S.C. 154(b) by 571 days.

(21) Appl. No.: 17/830,895

(22) Filed: Jun. 2, 2022

(65) Prior Publication Data

US 2022/0390116 A1 Dec. 8, 2022

Related U.S. Application Data

(60) Provisional application No. 63/195,925, filed on Jun. 2, 2021.

(51) Int. Cl.
*F24B 1/189* (2006.01)
*F24C 3/00* (2006.01)
*F24C 15/32* (2006.01)

(52) U.S. Cl.
CPC ..... *F24B 1/189* (2013.01); *F24C 3/004* (2013.01); *F24C 15/322* (2013.01)

(58) Field of Classification Search
CPC ..... F24B 1/189; F24C 3/004; F24C 15/322; F24F 7/06; F24F 11/0001; F24F 13/02
USPC ..... 126/512
See application file for complete search history.

(56) References Cited

U.S. PATENT DOCUMENTS

| | | | | |
|---|---|---|---|---|
| 1,670,034 A | | 5/1928 | Hallberg | |
| 3,998,203 A | | 12/1976 | Jensen | |
| 4,050,441 A | | 9/1977 | Horwinski | |
| 4,102,319 A | | 7/1978 | Koopmeiners | |
| 4,112,914 A | * | 9/1978 | Brown | F24B 1/18 126/502 |
| 4,143,638 A | | 3/1979 | Kamstra et al. | |

(Continued)

FOREIGN PATENT DOCUMENTS

| | | | | |
|---|---|---|---|---|
| GB | 260800 A | * | 11/1926 | F24B 1/182 |
| GB | 2004359 A | * | 3/1979 | F24B 1/1885 |

(Continued)

OTHER PUBLICATIONS

Korean to English machine translation for KR_100582735_B1.*

*Primary Examiner* — Michael G Hoang
*Assistant Examiner* — Elizabeth Ann Laughlin
(74) *Attorney, Agent, or Firm* — Sandberg Phoenix & von Gontard PC; G. Harley Blosser

(57) ABSTRACT

A vent-free fireplace heat removal system and accessories for installation of components for same, and methods for removal utilizing same. The system includes components so that when in use, heat generated in the combustion space escapes into the room in which the fireplace is situated, and heat in the room within a determined distance from the fireplace enters a slot, collects in a collection duct, and passes through a heat exhaust aperture to be expelled from the room. In certain embodiments, a fan system enhances the ability of the vent-free fireplace to expel heat.

4 Claims, 7 Drawing Sheets

(56) References Cited

U.S. PATENT DOCUMENTS

| | | | | | |
|---|---|---|---|---|---|
| 4,215,669 | A | | 8/1980 | Kerch | |
| 4,257,390 | A | | 3/1981 | Synan | |
| 4,334,518 | A | | 6/1982 | Ort | |
| 4,404,954 | A | | 9/1983 | Steel | |
| 5,701,882 | A | * | 12/1997 | Champion | F24B 1/191 126/528 |
| 5,906,197 | A | * | 5/1999 | French | F24B 1/1808 126/528 |
| 5,947,112 | A | | 9/1999 | Hawkinson | |
| 5,983,890 | A | | 11/1999 | Thomas et al. | |
| 6,003,507 | A | | 12/1999 | Flick et al. | |
| 6,019,099 | A | | 2/2000 | Shimek et al. | |
| 6,029,654 | A | * | 2/2000 | Wade | F24B 1/18 126/529 |
| 6,543,698 | B1 | | 4/2003 | Lyons et al. | |
| 6,908,039 | B2 | * | 6/2005 | Lyons | F24B 1/1808 237/55 |
| 2006/0185666 | A1 | * | 8/2006 | Bachinski | F24B 13/004 126/521 |
| 2019/0316777 | A1 | | 10/2019 | Little et al. | |

FOREIGN PATENT DOCUMENTS

| | | | | | |
|---|---|---|---|---|---|
| GB | 2334329 | A | * | 8/1999 | F23M 5/00 |
| KR | 100582735 | B1 | * | 6/2006 | F24B 1/02 |
| WO | WO-2010126334 | A2 | * | 11/2010 | F24C 15/006 |

* cited by examiner

VENT-FREE FIREPLACE HEAT REMOVAL SYSTEM AND ACCESSORIES ADAPTED FOR REMOVAL OF EXCESS HEAT FROM A ROOM WHEREIN THE VENT-FREE FIREPLACE IS LOCATED

CROSS-REFERENCE TO RELATED APPLICATIONS

This application claims priority to U.S. Application 63/195,925 filed Jun. 2, 2021, which is incorporated herein by reference.

STATEMENT REGARDING FEDERALLY SPONSORED RESEARCH OR DEVELOPMENT

Not Applicable.

FIELD OF THE INVENTION

The present disclosure relates generally to fireplace systems and, in particular, to vent-free fireplace systems. More specifically, this disclosure relates to such a vent-free fireplace system which incorporates an apparatus, mechanism, or accessory for controlling the amount of heat generated in a room and for removing excessive heat from the room where such a vent-free fireplace is installed.

BACKGROUND

The statements in this section merely provide background information related to the present disclosure and are not intended to be limiting and may not constitute prior art.

Fire and fireplaces are known and used as a source of heat in cooler weather and temperatures. Fireplaces can be specially designed to fit into a variety of types of spaces, including indoor and outdoor spaces, as well as tailored to meet specific requirements of the space to be heated, or to meet the needs of the consumer. In addition to the heat generated, burning a fire in a fireplace may also provide visual and auditory aesthetic appeal to the users, thereby providing a generally enjoyable ambiance and comfort to the space. As such, they are commonly installed in the interior spaces of residences, apartment buildings, hotels, or even in some commercial buildings.

Fire burning in a fireplace can generate excessive heat, thus making the room or space including the fireplace too hot and uncomfortable. Especially in regions or geographical locations that have a generally warmer climate or whose winters are short, such as the southwest United States, the weather does not typically cool off for enough long periods of time to justify installing a fireplace as a secondary heat source. As such, fireplaces are not as typically used in these regions for heat generation, and therefore, some of the desirable draws of owning and operating a fireplace, such as their beauty and ambiance, may be missed.

Various types of fireplaces are known and in customary use today. In particular, "vent-free" fireplace systems provide for an alternative to other systems such as "direct-vent" fireplace systems or "B-vent" systems.

Vent-free systems, as the name suggests, do not require an installed ventilation system. They operate by drawing air into their combustion chamber directly from the room space and expelling the combustion byproducts back into the same room space. In contrast, a direct-vent fireplace has a completely sealed combustion chamber which allows it to vent directly out a side wall or through the ceiling of a dwelling via an installed vent system. They essentially involve two parts, one for the exhaust and one for combustion air intake. A "B-vent" fireplace, sometimes referred to as a Natural Vent appliance system uses pipe (i.e., b-vent) that must be installed through the home and terminate above the roof. They may use some room air for combustion, but the amount of air they use is quite minimal. Source: northlineexpress-.com. This disclosure relates only to improvements in what are known in the industry described herein as "vent-free" fireplace systems and provide for eliminating or reducing heat generated by the vent-free fireplace from and within the interior space in which they are, or are designed to be, located.

What is needed is a vent free fireplace system and related accessories for use with a vent-free fireplace system, which are configured together for the purpose of drawing a predetermined level of heat, i.e., heat deemed excessive, from the area surrounding the fireplace, and expelling same to the exterior of the area around the vent-free fireplace, and preferably, from the living space containing it altogether.

BRIEF SUMMARY

The present disclosure is of a vent-free fireplace system or accessory to be added to an existing or free-standing vent-free fireplace, configured to be installed in the interior of a room in a substantially enclosed structure to reduce or eliminate heat deemed excessive generated by the vent-free fireplace from the installed interior space. The vent-free fireplace system of the disclosure includes an outer housing or shell structure including an outer housing panel(s), an inner chamber enclosed within the outer housing comprising an inner structure defining one or more air channels between the outer housing and the inner chamber, a burner positioned in the one or more air channels, and an aperture defined in the chamber and in preferred embodiments, positioned above the burner. The vent-free fireplace system or accessory to be fitted to a vent-free fireplace, further includes a slot defining a void and having front and rear faces. When installed, the front face of the slot faces the interior of the room in which the vent-free fireplace is situated. The vent-free fireplace system or accessory of the disclosure further includes a collection duct which communicates with the rear face of the slot. A heat exhaust aperture is defined in an upper surface of the collection duct and includes a mating feature. The system or accessory also includes a heat exhaust duct with a first end which mates with the heat exhaust aperture and a second end being exposed to the exterior of the room where the vent-free fireplace system is installed. As described herein, when the vent-free fireplace system or accessory is installed and in use, air is drawn into the fireplace from the occupied room and heat in the combustion space of the chamber generated escapes into the room. However, the vent-free fireplace system or accessory is configured so that heat in the room, when deemed excessive, or at a pre-set temperature and/or within a determined distance of the vent-free fireplace, can enter the slot, collect in the collection duct, and pass through the heat exhaust aperture into the heat exhaust duct to be expelled from the room where the vent-free fireplace system is installed.

In another aspect, an embodiment of the vent-free fireplace system or accessory of the disclosure includes a main cabinet defined as an outer housing. The outer housing has a top panel, a bottom panel, at least one side panel, with three side panels being typical to define a rectangular cube-like space. The cabinet has a first width that is approximately uniform from the top panel to the bottom panel and towards the rear side panel. The top and bottom panel and the three side panels can form a substantially cube-shaped cabinet with a defined interior space, with the interior space exposed through an open, removed, and/or glassed-surface front side. The front side may be either partly or entirely removed.

Further, according to this additional aspect, the vent-free fireplace system or accessory includes an internal combustion chamber, generally also defined, e.g., as a cube-like structure with the front removed, thereby defining a window. The width of the combustion chamber is, in the typical embodiment, substantially smaller than that of the housing cabinet and is positioned within the cabinet. The bottom panel of the cabinet can be defined with, e.g., an elongated aperture for a burner to provide gas fuel to the interior of the combustion chamber. The supplied fuel, when ignited, enables a burning flame to be sustained within the chamber. The chamber is positioned inside the housing with a continuous air channel positioned between, e.g., the sides such that the chamber is entirely encompassed within the surrounding air channel and does not contact the cabinet at any side. Further regarding this embodiment, a front panel is positioned at the front exposed side of the cabinet and the chamber, thereby connecting them to each other. The front panel can include a removed portion that defines a window for viewing a burning flame on the interior of the combustion chamber. In this embodiment, the front panel extends vertically above and below the top and bottom surfaces of the cabinet, respectively, to define top and bottom mounting panels for mounting the vent-free fireplace system to the interior of a wall of a room where the vent-free fireplace is installed.

In this disclosed embodiment, the top mounting panel is defined with an elongated slot positioned above the window open to the interior room with the width of the slot being approximately the same as the cabinet. A burner is positioned within the cabinet to supply the gas, thereby enabling a burning flame to be sustained where it can be viewed through the front window. When in use, ambient air in the interior of the room in which the vent-free fireplace is installed will flow into the fireplace's combustion chamber, and heated air flowing out of the combustion chamber will naturally heat the space in which the vent-free fireplace is installed, via convection. A collection duct is positioned, e.g., behind the slot in the top mounting panel, and above the combustion chamber where the heated air will first tend to congregate prior to spreading out into the surrounding space. In this disclosed embodiment, the duct tapers inwards towards the rear and towards an exhaust aperture defined behind the wall in the top surface of the collection duct. A heat exhaust duct can mate with the top of the heat exhaust aperture in an airtight seal on a mating feature of the heat exhaust aperture. The heat exhaust duct can extend from the first end that mates with the heat exhaust aperture to a second end, e.g., terminating on an exterior wall of the structure in which the vent-free fireplace is installed.

According to another embodiment, a blower motor, or exhaust fan system is positioned at any point along the exhaust path from the entrance slot to the second terminated end of the heat exhaust duct. The blower motor can be turned on manually, or, e.g., automatically using a controller, when a certain temperature-activated switch near or at the vent-free fireplace, reaches a selected temperature, in order to create an airflow, drawing heat deemed to be excessive (or above the threshold temperature within a certain radius) and remove same from the room into the slot through the exhaust path to be expelled, thereby exiting the room where the vent-free fireplace is installed. Methods of using these and additional embodiments of the vent-free fireplace systems and accessories, as exemplified, illustrated, or whose principles are set forth herein, are also disclosed herein.

Further features of the present disclosure will be in part apparent and in part pointed out below. Various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

Corresponding reference numerals will be used throughout the several figures of the drawings.

DETAILED DESCRIPTION

Figure 1:
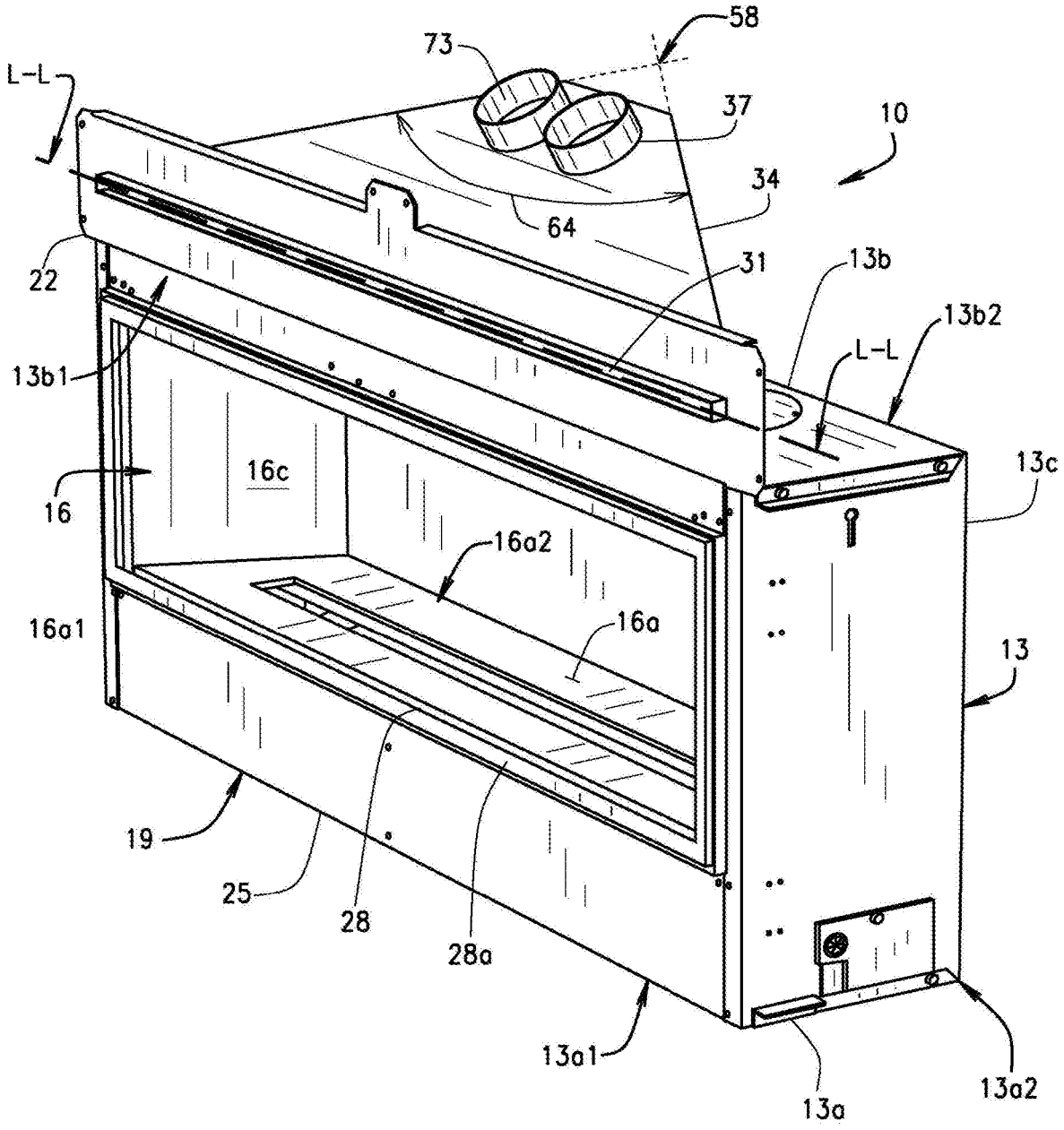
FIG. 1 shows a perspective view of an embodiment of a vent-free fireplace system or accessory disclosing the heat removal apparatus.

The following detailed description illustrates the disclosure by way of example and not by way of limitation. This description enables one skilled in the art to make and use the claimed invention, and describes several embodiments, adaptations, variations, alternatives, and uses of the claimed invention, including what Applicant believes to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Described generally, the present disclosure is of a vent-free fireplace system or accessory to be used in connection with an existing or free-standing vent-free fireplace for installation in the interior of a room in a substantially enclosed structure configured with the ability to reduce or eliminate heat generated by the vent-free fireplace from the installed space (i.e., one configured for heat removal/recovery). The vent-free fireplace system configured for heat removal/recovery from within an interior space includes an outer housing or shell structure which includes outer housing paneling(s) and an inner chamber enclosed within the outer housing. Between the outer housing and the inner chamber, the cabinet of the vent-free fireplace configured for heat removal/recovery can define one or more air channels, a burner positioned in the one or more air channels, and an aperture defined in the chamber and, in a preferred embodiment, positioned above the burner. The vent-free fireplace system/accessory configured for heat removal, further includes a slot defining a void and having front and rear faces. When installed, the front face of the slot faces the interior of the room in which the vent-free fireplace is situated and serves to capture heated air to be exhausted from a certain defined perimeter around the fireplace. The vent-free fireplace system/accessory configured for heat removal of the disclosure further includes a collection duct which communicates with the rear face of the slot. A heat exhaust aperture is defined in an upper surface of the collection duct and includes a mating feature. The system/accessory further includes a heat exhaust duct with a first end which mates with the heat exhaust aperture and a second end which is exposed to the exterior of the room where the vent-free fireplace is installed. As further described herein, when the vent-free fireplace system/accessory is installed and in operation, ambient air in the room or space containing the vent-free fireplace is drawn in and combusted, as is generally known and described as to vent-free fireplace systems. However, heat generated in the combustion space of the chamber escapes into the room and can become, or deemed, excessive. However, the vent-free fireplace heat removal system/accessory is configured so that heated air in the room, when deemed excessive, or, e.g., automatically when a pre-set temperature is reached at or within a determined distance of the vent-free fireplace, can enter the described slot or slots, collect in the collection duct, and pass through the heat exhaust aperture into the heat exhaust duct to be expelled from the room where the vent-free fireplace is installed. Additionally, preferably, the collection duct slot is located at a defined position relative to the combustion chamber opening, this position having been determined to allow the heated air to flow efficiently into the collection duct. The disclosure of such a system is detailed below.

According to the disclosed embodiment set forth in FIG. 1, a vent-free fireplace heat removal system/accessory 10 is adapted to be installed in an interior room of an enclosed structure. The interior room, e.g., may be a room which is not large enough for the heated air to dissipate comfortably from the space near or around the fireplace. Additionally, it may be one intended to be maintained at a lower temperature despite the generation of heat by an enclosed vent-free fireplace for any number of reasons. In this embodiment, the heat removal system/accessory 10 comprises an outer housing 13, a combustion chamber or cabinet 16, front panel 19 comprising a top mounting panel 22, a bottom mounting panel 25 and a front window 28. The window portion 28 of the front side may also comprise a window frame 28*a* for supporting a heat resistant glass or screen to protect the room from a burning flame inside the combustion chamber. The top mounting panel 22 of the front panel 19 includes a slot aperture 31 that is exposed to the front surface 22*a* of the top mounting panel 22 and which passes through to the rear surface 22*b* of the top mounting panel 22, thereby defining a pass-through slot aperture 31. The vent-free fireplace system/accessory 10 further comprises a collection duct 34 connected to the rear face of the slot 31, and extending rearward, before terminating at a heat exhaust aperture 37 defined in the upper surface of the collection duct 34. The vent-free fireplace heat removal system/accessory 10 further includes a heat exhaust duct 40 connected to the heat exhaust aperture where heat that collects at the front of the slot 31 is drawn in, e.g., by a blower motor to pass through the collection duct 34 through heat exhaust duct 40 to be expelled to the outside of the room, e.g., to the outside of the structure.

In this disclosed embodiment, the outer housing 13 of the vent-free fireplace system/accessory 10 preferably includes the following structures: a bottom panel 13*a* defining a floor, a top panel 13*b* defining a ceiling, and at least one side panel 13*c*, preferably three side panels, connected to create an interior space. The bottom panel 13*a* includes a front facing edge 13*a*1 having a first width, a rear facing edge 13*a*2, and at least one side edge. The top panel 13*b* includes a corresponding front facing edge 13*b*1 having a width substantially similar to the first width of the bottom panel front edge 13*a*1, a corresponding rear facing edge 13*b*2, and at least one corresponding side facing edge. The bottom panel 13*a* and the top panel 13*b* are connected at least at the rear edge 13*a*2, 13*b*2 by the at least one side panel 13*c* extending from the bottom panel rear facing edge 13*a*2 in a direction towards the top panel rear facing edge 13*b*2, wherein the top panel 13*b*, the bottom panel 13*a*, and the at least one side panel 13*c* are fixed relative to each other, thereby defining the interior space enclosed by the outer housing 13 having a width substantially similar to the first width. The outer housing 13 may further include second and third side panels 13*c* to enclose the interior space on two sides. The side panels 13*c* are preferably connected serially at the side edges, thereby enclosing the interior space on three sides of a defined cabinet or combustion chamber 16, with the top panel 13*b* and the bottom panel 13*a* defining the top and bottom of the cabinet, essentially. As such, the interior space can be defined as having a configuration with five sides, respectively, with the front side removed, in whole or in part, to expose the interior space of the cabinet substantially in the shape of a cube. Glass front and sides may replace one or more of these for viewing purposes.

In this embodiment, the interior combustion chamber 16 is substantially shaped similarly to and engulfed within the interior space defined by the cabinet 16 of the outer housing 13. Correspondingly, the interior combustion chamber 16 includes a bottom panel 16*a*, a top panel 16*b*, and at least one side panel 16*c*, more preferably three side panels 16*c*. The bottom panel 16*a* and the top panel 16*b* include a front facing edge 16*a*1, 16*b*1 defining a second width smaller than the first width of the outer housing 13, and a rear facing edge 16*a*2, 16*b*2, respectively, with the bottom panel 16*a* and the top panel 16*b* being connected by the at least one side panel 16*c*. The side panel 16*c* is connected to the bottom panel 16*a* and the top panel 16*b* at the rear edges 16*a*2, 16*b*2, with the at least one side panel extending between the rear edges 16*a*2, 16*b*2, respectively. Like the outer housing 13, the interior combustion chamber or cabinet 16 can preferably include three side panels 16*c* connected serially at the side edges and extending from the bottom panel 16*a* to the top panel 16*b* at the edges, thereby connecting the two. The bottom panel 16*a*, the top panel 16*b*, and the at least one side panel 16*c*, preferably three side panels 16*c*, thereby enclosing the interior combustion chamber or cabinet 16 in a cube-like shape like the outer housing. The front side of the combustion chamber 16 can be removed, in whole or in part, thereby exposing the interior combustion space of the combustion chamber.

Figure 4:
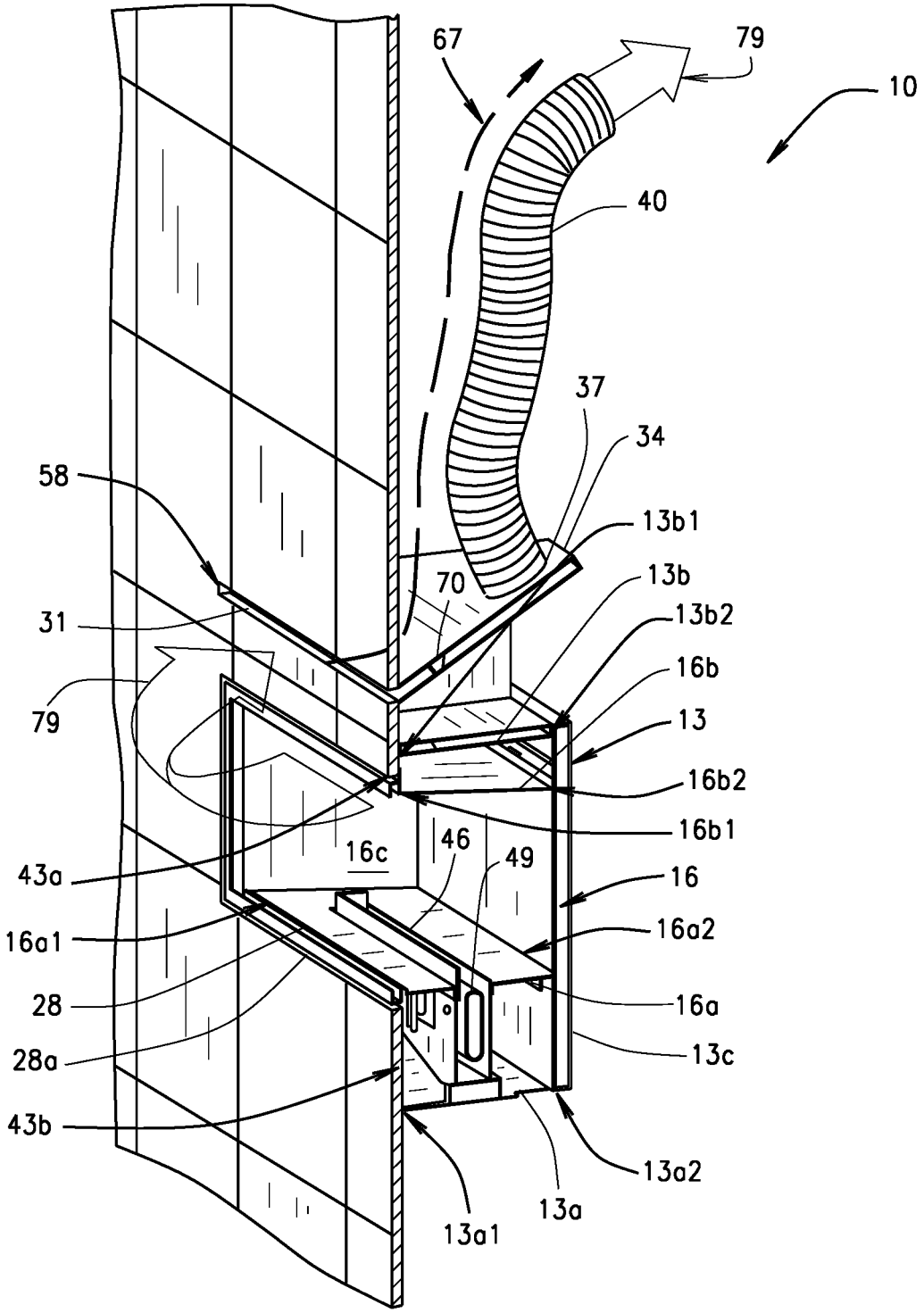
FIG. 4 shows a cross-sectional view of an embodiment of a vent-free fireplace system or accessory with the heat removal apparatus attached to the exhaust aperture.

With reference to FIGS. 1 and 4, the interior combustion chamber 16 in this embodiment is fixed relative to the outer housing 13 and is sized to be enclosed within the outer housing 13. A front panel 19, defining the front side of both the outer housing 13 and the interior combustion chamber 16, respectively, is positioned to extend from the front edge 13*b*1 of the top panel 13*b* of the outer housing 13 to the front edge 13*b*2 of the bottom panel 13*a*. The bottom panel and top panel 16*a*, 16*b* of the interior combustion chamber 16 are positioned above and below the bottom panel 13*a* and the top panel 13*b* of the outer housing 13, respectively, with a top air channel 43*a* and a bottom air channel 43*b* positioned between the interior combustion chamber 16 and the outer housing 13. In this embodiment, the interior combustion chamber 16 is connected to the front panel 19 at the front edges 16*a*1, 16*b*1 at a fixed position relative to the outer housing, wherein the front edges 13*a*1, 13*b*1 of the outer housing 13 and the front edges 16*a*1, 16*b*1 are fixed relative to each other via connection to the front panel 19. A center portion 19*a* of the front panel 19 is removed, thereby defining the front window 28 wherein the combustion space of the interior combustion chamber 16 is exposed. The portion of the front panel 19 that is not removed covers the forward-facing portion of the top and bottom air channels 43*a*, 43*b*, thereby fixing the outer housing 13, the interior combustion chamber 16, and the top and bottom air channels 43*a*, 43*b* relative to each other.

The front panel 19 can define a width greater than the width of the interior combustion chamber 16 and substantially like the width of the outer housing 13, with the front panel 19 including sides extending between the top and bottom portions of the front panel. The front panel 19, with the top portion, the bottom portion, and the side portions extending therebetween, essentially define a removed portion that thereby defines the front window 28. The side panels 13*c* of the outer housing and the side panels of the interior combustion chamber 16*c* are connected at the front edges by the side portions of the front panel 19, thereby defining side air channels. In this embodiment, the side air channels are continuous with the top and bottom air channels 43*a*, 43*b*, respectively, thereby engulfing the interior combustion chamber 16 within the outer housing 13.

In the depicted embodiment shown in FIG. 4, the bottom panel 16*a* of the interior combustion chamber 16 defines an elongated aperture 46 positioned to extend between the side edges of the bottom panel 16*a* along a line that approximately splits the bottom panel 16*a* into similarly sized front and back portions. A burner 49 is positioned in the bottom air channel 43*b* directly below the aperture 46 defined in the bottom panel 16*a*. The burner 49 can be formed, e.g., as a cylindrical tube or an elongated rectangular cube-like component, or the like, and extends along the length of the aperture 46. The top surface of the burner 49 is formed with a plurality of holes spaced between the two opposite ends of the aperture 46, such that when a combustible fuel, such as gas, passes through the holes, it then passes vertically through the aperture 46 in the bottom panel 16*a* of the combustion chamber 16, thereby entering the interior. The burner 49 can be plumbed to supply combustible fuel continuously to flow from the holes through the aperture 46 into the combustion chamber 16. The combustible fuel can be ignited by a spark or another flame, such as from a pilot, a lighter, or the like. Once ignited, the flow of the combustible fuel can sustain a continuous flame within the combustion chamber 16, thereby supporting the fire within the vent-free fireplace system 10. The burning flame inside the combustion chamber 16 is observable by users through the window 28 in the front panel 19 (or other glass-enclosing panels, depending on the vent-free fireplace design) for enjoying the visual ambiance.

The bottom mounting panel 25 having a width substantially similar to the first width of the cabinet extends substantially vertically downward from the bottom edge of the front panel 19. The bottom mounting panel 25 can be formed of a detachable panel from the front panel 19, or it can be formed continuously with the front panel 19. The bottom mounting panel 25 includes at least one mounting tab positioned at the approximate center position of the bottom edge and can include additional mounting tabs positioned at the sides of the bottom mounting panel. The mounting taps are used for mounting and securing the vent-free fireplace system 10 to drywall, or brick, or the interior of the wall of the room where the vent-free fireplace system/accessory 10 is installed.

The top mounting panel 22 extends substantially vertically upward from the top edge of the front panel 19. The top mounting panel 22 has a third width preferably larger than the first width. The top mounting panel 22 includes at least one mounting tab positioned at the approximate center of the top edge and can include additional mounting tabs positioned at the sides. The mounting tabs are used for mounting and securing the vent-free fireplace system 10 to drywall, or brick, or the interior of the wall of the room where the vent-free fireplace system 10 is installed.

Figure 2:
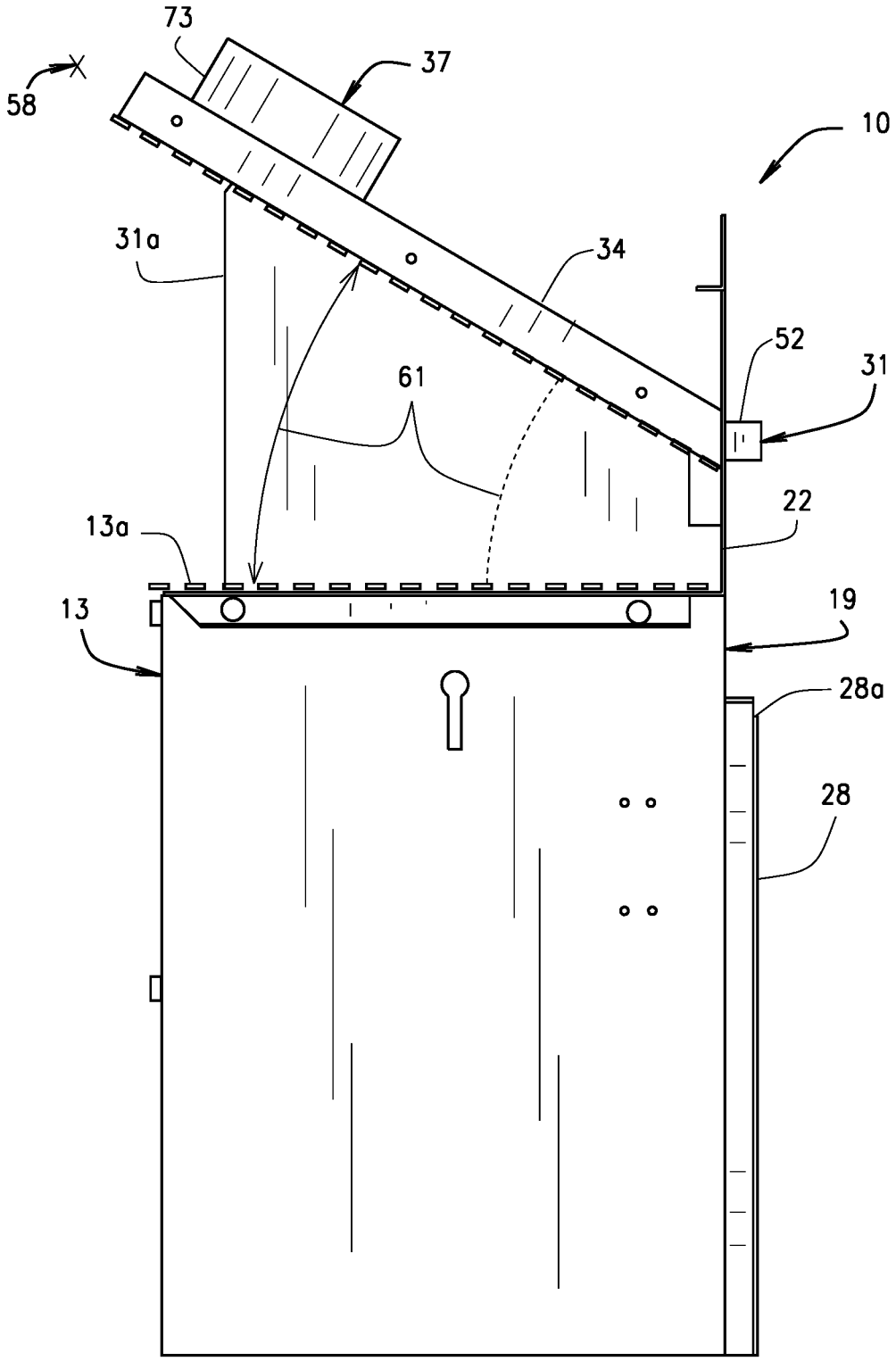
FIG. 2 shows a side view of the vent-free fireplace system or accessory of FIG. 1.

In the embodiment disclosed in FIGS. 1 and 2, the top mounting panel 22 includes the previously mentioned slot aperture 31 defined to extend longitudinally along a line L-L approximately splitting the top mounting panel 22 into two similarly sized vertical sections. In this embodiment, the slot aperture 31 extends longitudinally along line L-L approximately the same as the first width of the cabinet. The fourth width is selected such that it matches with the width of the outer housing 13 and is larger than the width of the internal combustion chamber 16.

Figure 3:
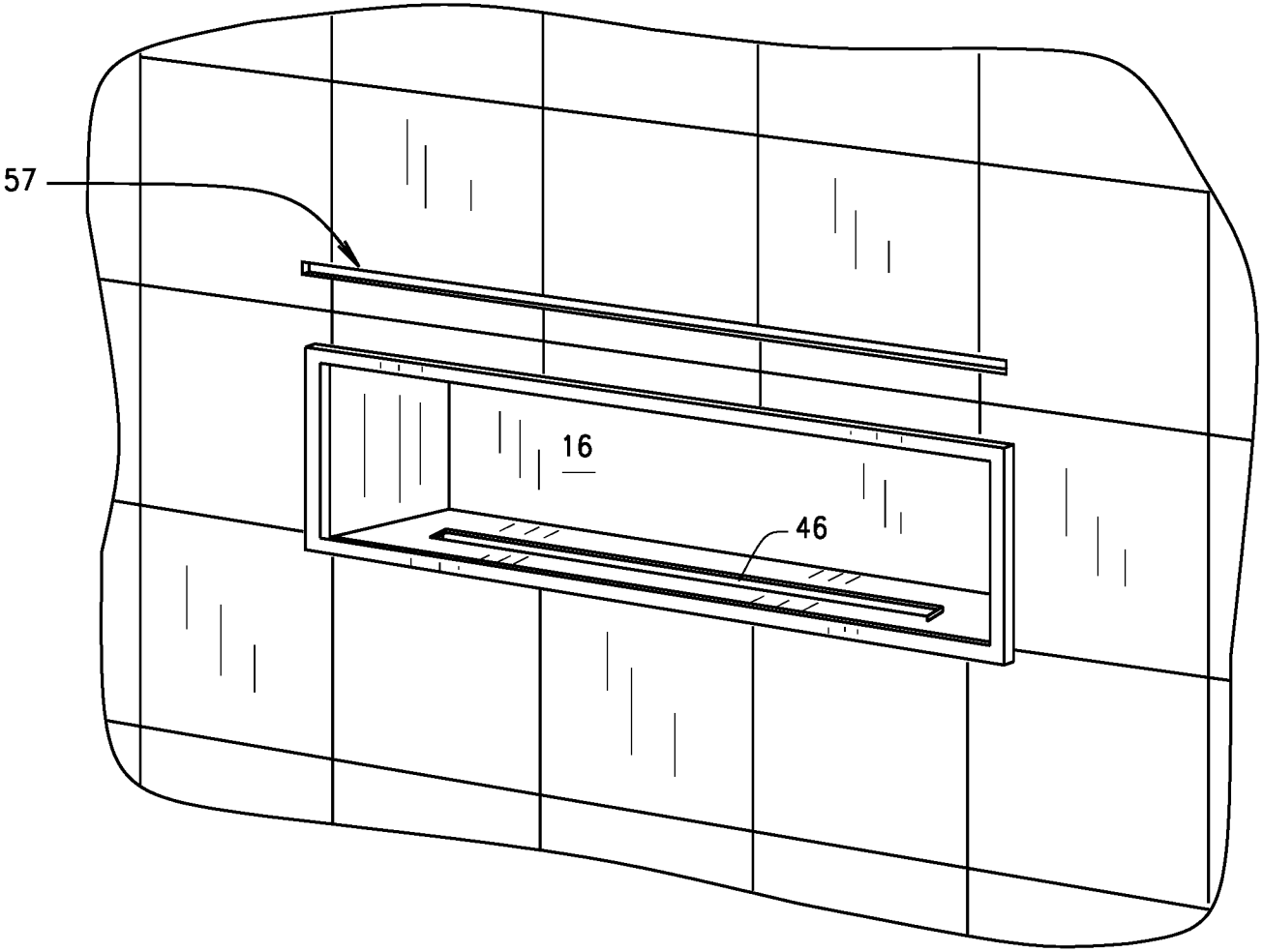
FIG. 3 shows a front perspective view of the vent-free fireplace system or accessory of FIG. 1 depicted as installed in a wall of a room where the vent-free fireplace is used.

Referring to FIGS. 2 and 3, either in a pre-fabricated vent-free heat removal fireplace system, or as an accessory to be installed in an existing or free-standing vent-free fireplace, the front-facing side of the top mounting panel 22 where the slot aperture 31 is exposed may be formed with a lip 52 that extends generally perpendicularly outwardly from the front surface of the top mounting panel 22. The lip 52 in this embodiment is positioned to completely encircle the outer edge of the aperture of the slot. In the embodiment depicted in FIGS. 1, 2 and 4, the collection duct 34 is positioned on the rear surface of the top mounting panel 22. The collection duct 34 has a front entrance portion that has a width approximately equal to that of the slot aperture 31, such that the collection duct 34 can mate with and mount on the rear surface of the top mounting panel 22 with the rear side or face of the slot aperture 31.

When mounted and installed, preferably the collection duct 34 extends rearwardly away from the rear surface of the top mounting panel 22. As shown in FIG. 2, the collection duct 34 can form an incline, such that as it extends rearwardly, it also extends upwardly away from the top surface of the top panel 13*a* of the cabinet to a position 58 behind the wall of the room where the vent-free fireplace 10 is installed and above the top surface of the cabinet, thereby forming an angle with the bottom surface of the collection duct and the top surface of the cabinet. The angle is acute or substantially V-shaped 61 and may have an angle in the range of about 0° to about 45°. As best seen in FIG. 2, the collection duct 34 can include a support bracket 34*a* that supports the weight of the collection duct as it extends towards the position 58 behind the wall. The support bracket 34*a* can include attachment features for attaching to the top surface of the cabinet. The collection duct 34 tapers as it extends away from the mounting point on the rear surface of the top mounting panel 22 to the position 58 behind the wall of the room. The collection duct 34 is designed in preferred embodiments to form an airtight seal with the open rear face of slot 31, thus preventing heated air from escaping into the wall.

With reference to FIGS. 1 and 4, the top surface of the collection duct 34 includes a heat exhaust aperture 37 positioned proximate to the position 58 behind the wall. The heat exhaust aperture 37 is formed in such a position that heated exhaust entering the collection duct 34 through slot 31 passes through the collection duct 34 traveling rearwardly and upwardly away from the front entrance towards the heat exhaust aperture 37, thereby defining an exhaust path 67 for heated exhaust to travel. The collection duct 34 includes at least one support vane 70 positioned inside the collection duct 34 along the exhaust path 67 such that, when installed, the height of the collection duct 34 and the exhaust path 67 that passes through the heat exhaust duct 34 maintains a consistent height from the front entrance towards the heat exhaust aperture 37. The collection duct 34 may include more than one support vane 70 based on the length of the path for maintaining a consistent open path for heat exhaust to escape.

In the disclosed embodiment, the heat exhaust aperture 37 terminates in a mating feature 73 formed in the top surface of the collection duct 34. The mating feature 73 is formed to mate with the first end of a heat exhaust duct 40 in an airtight seal where heated exhaust traveling through the collection duct 34 exits through the heat exhaust aperture 37 into the heat exhaust duct 40. The heat exhaust duct 40 includes a second end that terminates at a position outside of the room where the vent-free fireplace 10 is installed, thereby extending the exhaust path 67. The termination position will generally be exterior to the structure in which the vent-free fireplace is installed. The exhaust path 40 can be composed of a flexible hose-like heat-resistant material, similar to hoses that attach to a dryer.

Figure 5:
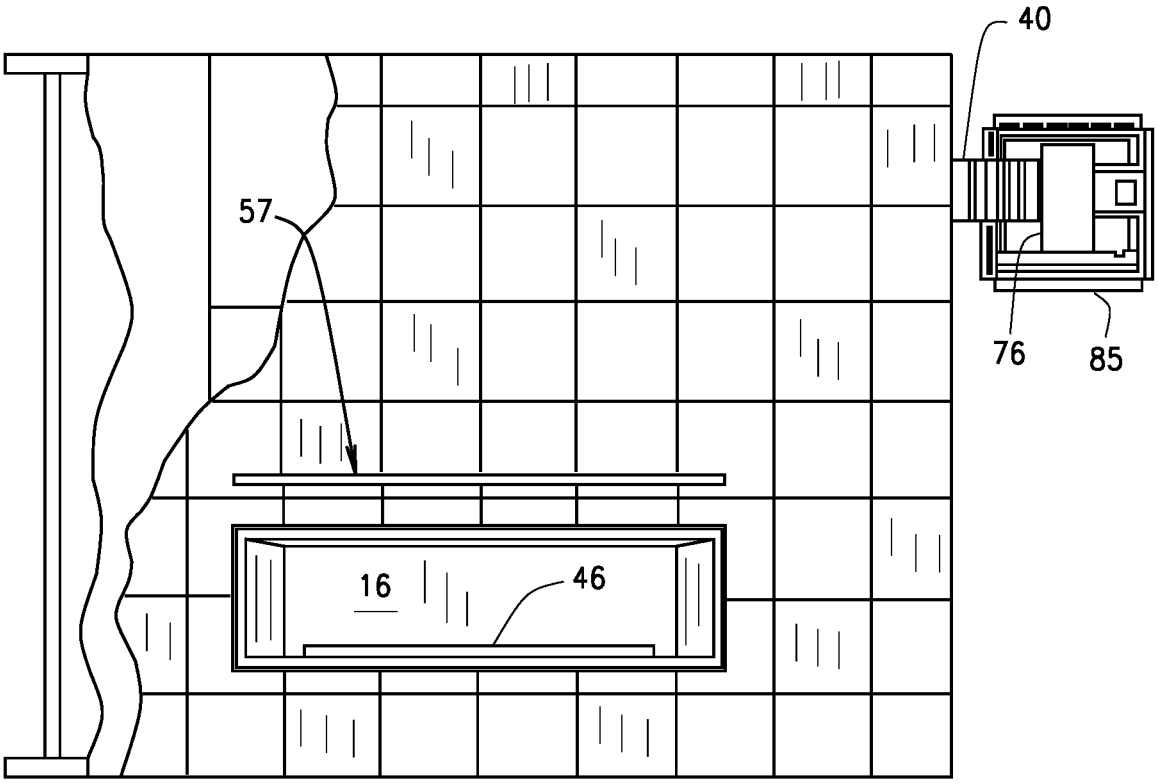
FIG. 5 shows a perspective view of a vent-free fireplace according to the disclosure installed in a wall of an interior room with a heat removal apparatus and an exhaust fan attached to an external attachment.
Figure 6:
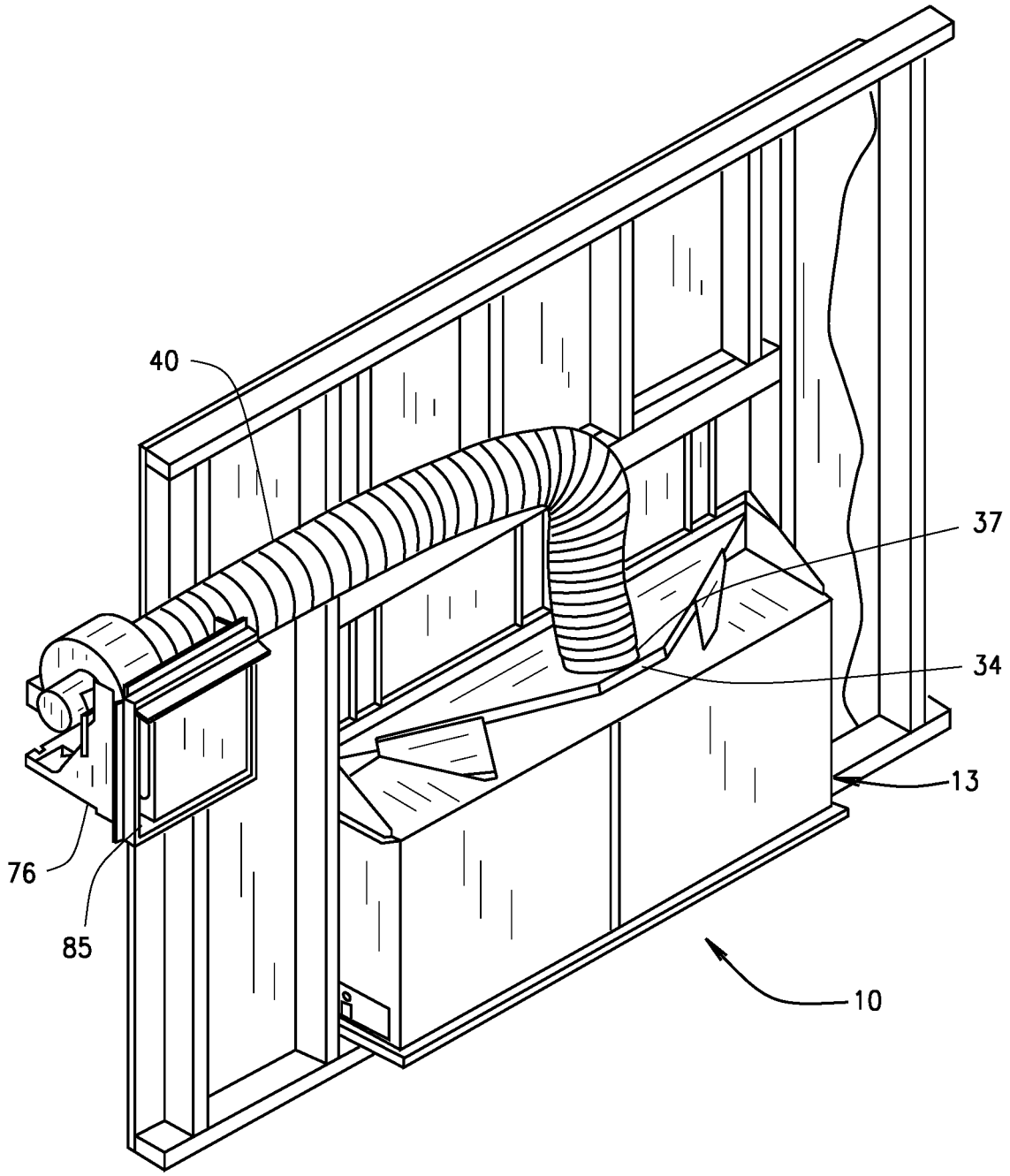
FIG. 6 shows a perspective view of an embodiment of a vent-free fireplace system or accessory according to the disclosure from behind the wall in which the system is installed.
Figure 7:
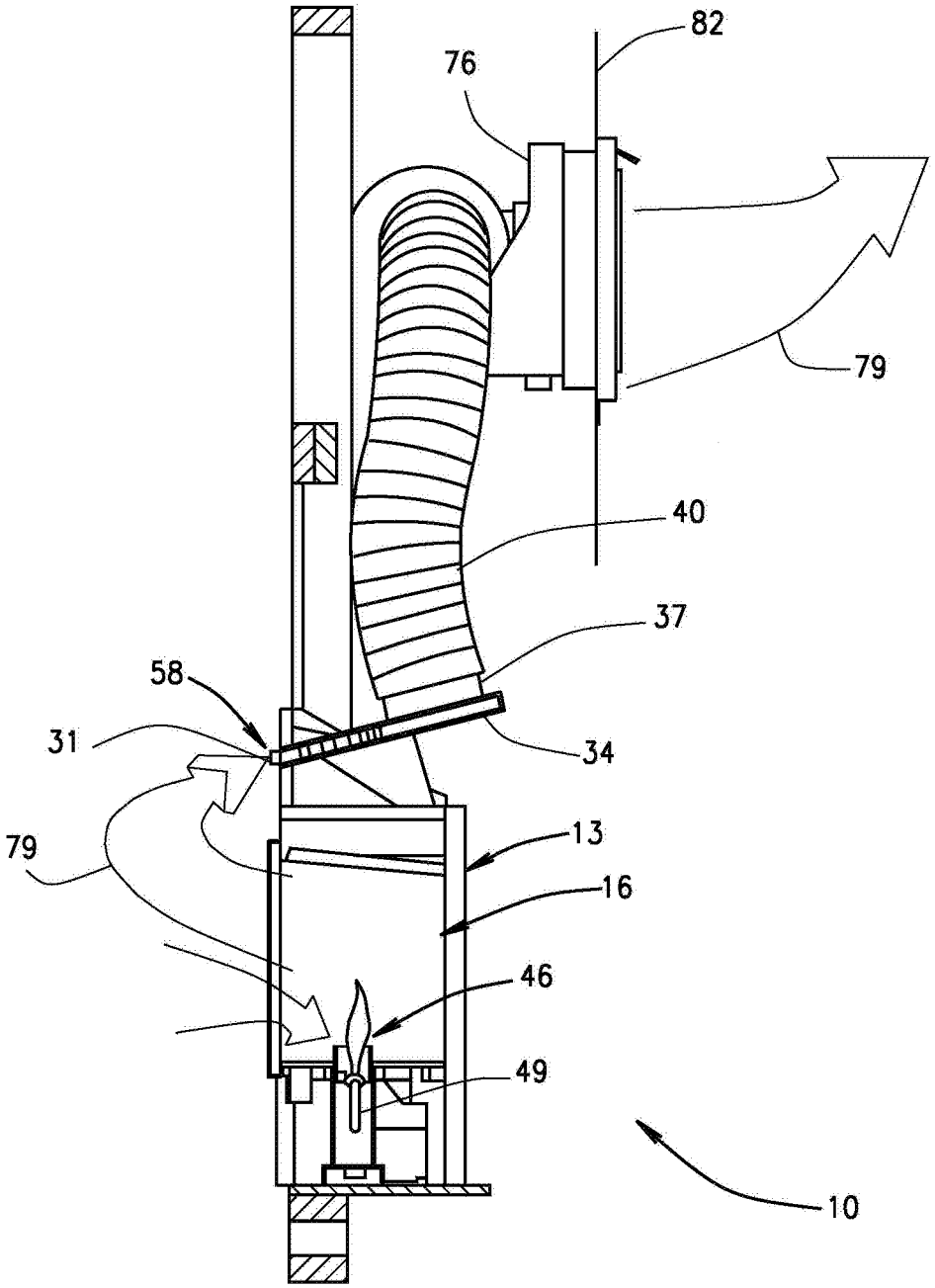
FIG. 7 is a side cross-sectional view of an embodiment of a vent-free fireplace system or accessory according to the disclosure with the exhaust path as shown from the interior room to the blower motor outside of the room.

FIG. 4 shows an embodiment wherein the exhaust path 67 begins at the front entrance of the collection duct 34 and continues along the collection duct 34 towards the heat exhaust aperture 37, then through the heat exhaust aperture 37 into the heat exhaust duct 40, where the heat exhaust duct 40 terminates at the second end. A blower motor 76, or a fan system, as shown in FIGS. 5-7, can be positioned in the exhaust path 67 at any position, although the second end of the heat exhaust duct 40 is the most likely position. As shown in FIG. 7, in certain embodiments, a blower motor 76 can be positioned on an exterior wall 82, such that the heated exhaust 79 can be drawn into the exhaust path 67 via an airflow created by the blower motor 76. The heated exhaust 79 can then be expelled out of a hose 85 attached to the second end of the exhaust duct 40.

The blower motor 76 can include an on/off feature, such that, when activated, the blower motor 76 initiates an airflow through the exhaust path 67, thereby drawing air, exhaust, and excess heat from the room into the exhaust path 67 to be expelled from the interior of the room.

The blower motor can be actuated manually, or in a temperature-controlled automated manner. If automated, a thermostat feature can be attached so that the blower is activated whenever a desired or otherwise determined temperature reading limit is reached.

When any of the disclosed embodiments described herein are in use, a burning flame is maintained in the internal combustion chamber 16 of the vent-free fireplace 10 as ambient air in the room the vent-free fireplace system is drawn into and contacts the fuel mix located therein. The sustained fire burning in the internal combustion chamber 16 generates heat 79, which may be deemed in excess, or above a certain set temperature, and which radiates out into the interior of the room containing the vent-free fireplace system, e.g., through the window 28 of the front panel 19. The heat may collect outside the window 28 at a position above the top edge of the window 28, generally in front of the slot 31, such that the blower motor 76 mounted along the exhaust path 67 can draw heated air and exhaust 79 collecting in the room above the window 28 into the slot 31, through the collection duct 34, through the heat exhaust aperture 37 into the heat exhaust duct 40 to be expelled through the second end of the heat exhaust duct 40 and from the room.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

The invention claimed is:

1. A vent-free fireplace heat removal system adapted to be installed in an interior of a room in a substantially enclosed structure, comprising:

an outer housing defined by a housing top panel having a first width, a housing bottom panel having a width substantially similar to the first width, and at least one housing side panel connected to an edge of the housing top panel at a top edge of the housing side panel and connected to an edge of the housing bottom panel at a bottom edge of the housing side panel, thereby connecting the housing top panel to the housing bottom panel, the connected housing panels defining a cabinet with an interior space;

a chamber defined by a chamber top panel having a second width positioned proximate to and below the housing top panel creating a first air channel therebetween the chamber top panel and the housing top panel, the second width being smaller than the first width, a chamber bottom panel having a width substantially similar to the second width positioned proximate to and above the housing bottom panel creating a second air channel therebetween the chamber bottom panel and the housing bottom panel, the width of the chamber bottom panel being substantially the same as the width of the chamber top panel and smaller than the width of the housing bottom panel, at least one chamber side panel connected to an edge of the chamber top panel at a top edge and connected to an edge of the chamber bottom panel at a bottom edge, the at least one chamber side panel positioned proximate to and opposite from the at least one housing side panel, wherein the connected chamber panels define an interior combustion space within the chamber, the interior combustion space positioned at least substantially within the interior space of the cabinet, a front panel positioned at a front facing portion of the cabinet, the front panel extending between the housing top panel and the housing bottom panel, thereby connecting the housing top panel to the housing bottom panel at front facing edges, wherein a front facing edge of the chamber top panel connects to the front panel at a position below the front facing edge of the housing top panel and a front facing edge of the chamber bottom panel connects to the front panel at a position above the front facing edge of the housing bottom panel;

a top edge of the front panel positioned generally vertically above a position where the housing top panel connects to the front panel thereby creating a top mounting panel, wherein a third width of the top mounting panel is larger than the first width and a bottom edge of the front panel positioned generally vertically below a position where the housing bottom panel connects to the front panel thereby defining a bottom mounting panel, a window defined in the front of the front panel, wherein a portion of the front panel is removed, thereby exposing the interior of the combustion space, an elongated aperture defined in the chamber bottom panel, with a portion of the chamber bottom panel removed to expose a portion of the air channel between the chamber bottom panel and the housing bottom panel, a burner, defined as a gas supply line including a plurality of gas supply holes along an upper surface of the burner, positioned in the air channel below the aperture such that when gas is supplied to the burner as a fuel, it can pass generally vertically through the plurality of holes in the surface of the gas supply line, through the aperture into the combustion space, whereby when ignited, a burning flame can be sustained, a slot defining an elongated void that passes through the top mounting panel, wherein when installed, a front of the slot is exposed to the interior of the room where the vent-free fireplace is installed, a collection duct positioned on a rear surface of the top mounting panel behind the slot, the collection duct sized to mate with a rear facing side of the slot, wherein the collection duct extends rearward from the rear surface of the top mounting panel to a position behind the top mounting panel, a heat exhaust aperture defined in an upper surface of the collection duct, the heat exhaust aperture including a mating feature on the upper surface, a heat exhaust duct with a first end and a second end, the first end mating with the heat exhaust aperture defined in the upper surface of the collection duct and the second end of the heat exhaust duct being exposed to an exterior of the room where the vent-free fireplace system is installed, wherein, when the vent-free fireplace system is in use, heat in the combustion space of the chamber generated by the burning flame escapes into the room through the window defined in the front panel of the vent-free fireplace system, heat collects in the room up to at least a set distance from the exposed front of the elongated slot defined in the top mounting panel, wherein said heat in the room within up to at least the set distance can enter the front of the slot, collect in the collection duct, and pass through the heat exhaust aperture into the heat exhaust duct, whereby, heat that enters the heat exhaust duct is thereby expelled through the second end of the heat exhaust duct, thereby exiting the room where the vent-free fireplace is installed.

2. The vent-free fireplace heat removal system as set forth in claim 1 wherein an exhaust path is defined extending from an entrance of the slot through the collection duct, into the heat exhaust duct to the second end of the heat exhaust duct, and wherein the vent-free fireplace system further comprises a fan system positioned in the exhaust path, the fan system being configured to be activated when the vent-free fireplace system is in use for drawing heat from the room into the exhaust path through the slot and propelling the heat through the exhaust path to the second end of the heat exhaust duct.

3. The vent-free fireplace heat removal system as set forth in claim 1, wherein heat that is drawn through the exhaust path is expelled from the room where the vent-free fireplace is installed to an exterior of a substantially enclosed structure enclosing the room.

4. The vent-free fireplace heat removal system as set forth in claim 1, wherein the connection duct extends in a direction substantially upwardly away from the top surface of the housing top panel, thereby defining a substantially V-shaped angle between the housing top panel and the bottom surface of the collection duct.

* * * * *